United States Patent [19]

Wagner

[11] Patent Number: 4,753,281

[45] Date of Patent: Jun. 28, 1988

[54] ADJUSTABLE SHADE

[75] Inventor: John S. Wagner, Madison, Wis.

[73] Assignee: Graber Industries, Inc., Middleton, Wis.

[21] Appl. No.: 11,294

[22] Filed: Feb. 5, 1987

[51] Int. Cl.[4] ..... E06B 3/94

[52] U.S. Cl. ..... 160/84.1; 160/279; 242/157 R

[58] Field of Search ..... 160/84 R, 279, 178 C, 160/166 R, 172, 259, 167, 178 R, 344, 345; 242/157 R; 254/389; 24/141, 142, 135 N; 16/2, 210

[56] References Cited

U.S. PATENT DOCUMENTS

| | | | |
|---|---|---|---|
| 1,289,281 | 12/1918 | Shaft . | |
| 1,663,819 | 3/1928 | Shaft . | |
| 3,192,991 | 7/1965 | Anderle | 160/172 X |
| 3,465,806 | 9/1969 | Sulkes | 160/84 R |
| 3,506,999 | 4/1970 | Neher | 254/389 X |
| 3,721,285 | 3/1973 | Debs | 160/166 R |
| 3,818,969 | 6/1974 | Debs | 160/172 X |
| 4,202,395 | 5/1980 | Heck et al. | 160/84 R |
| 4,473,101 | 9/1984 | Langeler | 160/279 X |
| 4,557,309 | 12/1985 | Judkins | 160/84 R |
| 4,593,737 | 6/1986 | Clemente | 160/84 R |
| 4,673,018 | 6/1987 | Judkins | 160/84 R |
| 4,679,610 | 7/1987 | Spraggins | 160/84 R X |
| 4,687,038 | 8/1987 | Clemente | 160/84 R |

*Primary Examiner*—Ramon S. Britts
*Assistant Examiner*—David M. Purol
*Attorney, Agent, or Firm*—Vernon J. Pillote

[57] ABSTRACT

An adjustable shade including first and second parallel headrails and an intermediate rail between the headrails with a foldable shade member attached to the intermediate rail and to one of the headrails. The shade member has rows of aligned openings therethrough and the headrails and intermediate rail have openings aligned with the rows of openings in the shade member. Tension cords extend through the rows of openings in the shade member and through the openings in the headrails and intermediate rail to guide the intermediate rail and shade member during movement between open and closed positions. The draw cords are attached to the intermediate rail and extend through the rows of openings in the shade member and through the headrails, and the draw cords have an operating portion that extends between the headrails and which can be grasped to move the intermediate rail in both directions relative to the headrails. Guide bushings are provided in the openings in the headrails and guide buttons are mounted in the guide bushings. The guide buttons have a notch to allow the draw cords to pass through the openings in the guide bushings and a tension cord passage spaced from the notch for receiving the tension cords to maintain the draw cords and tension cords separated as they pass into and out of the head rails.

14 Claims, 3 Drawing Sheets

Fig. 1.
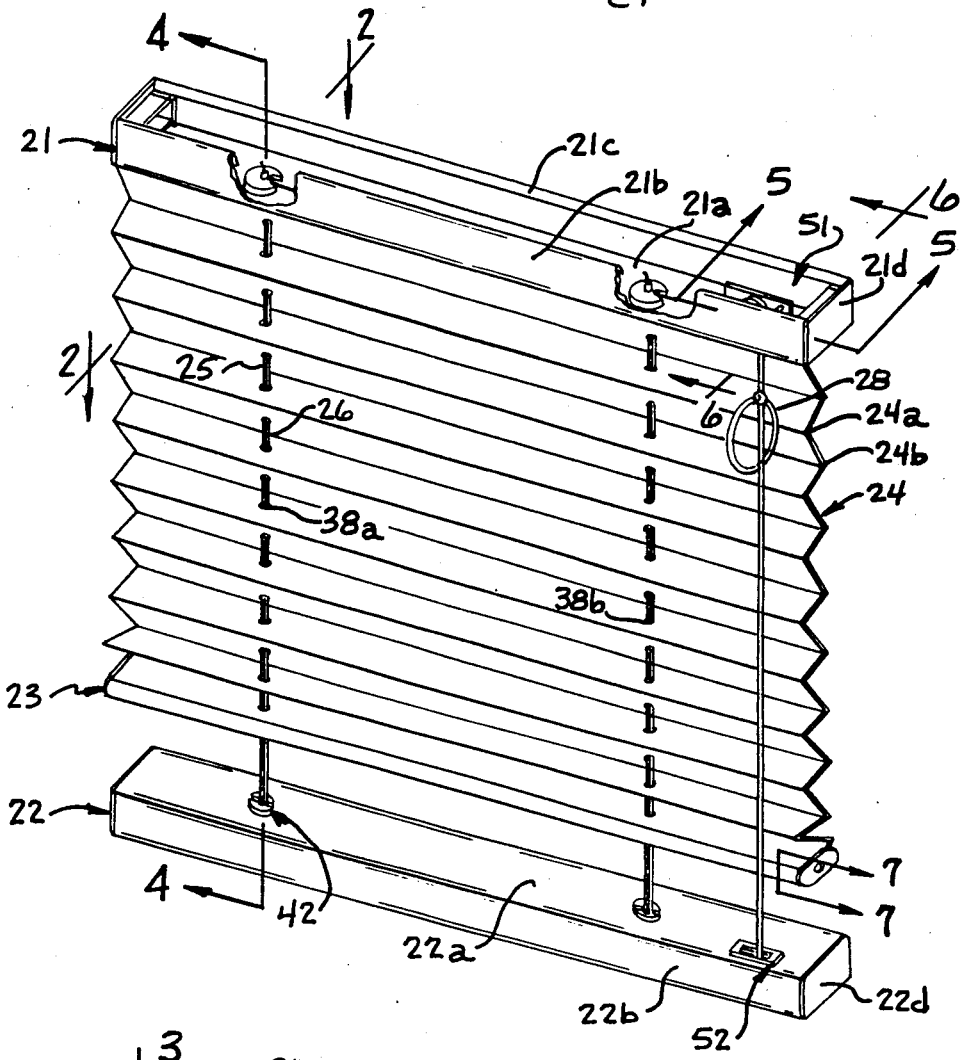
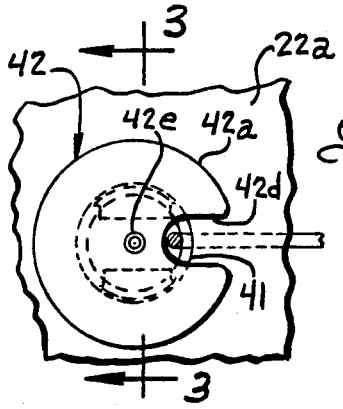
Fig. 2.
Fig. 3.
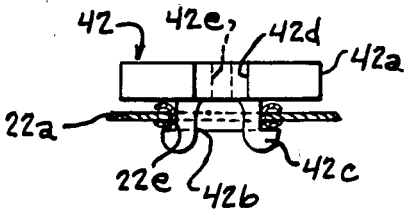

Fig. 4.
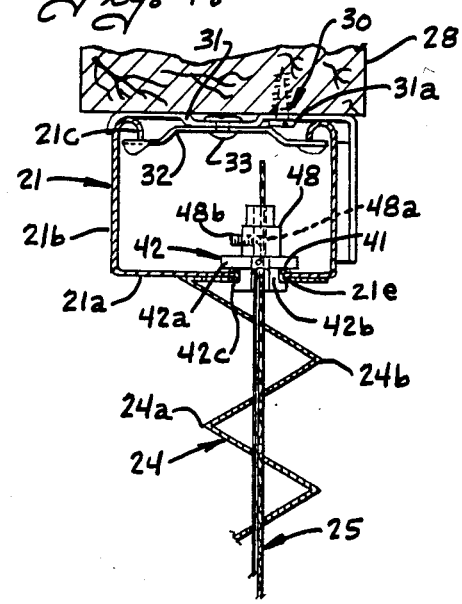
Fig. 5.
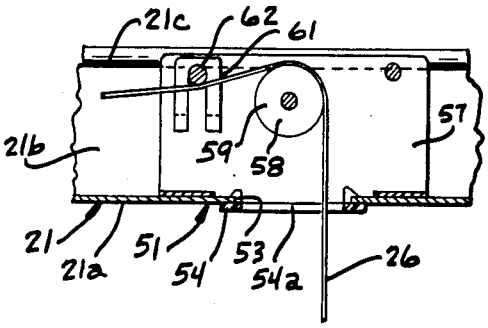
Fig. 6.
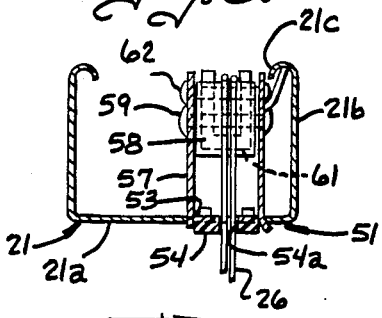
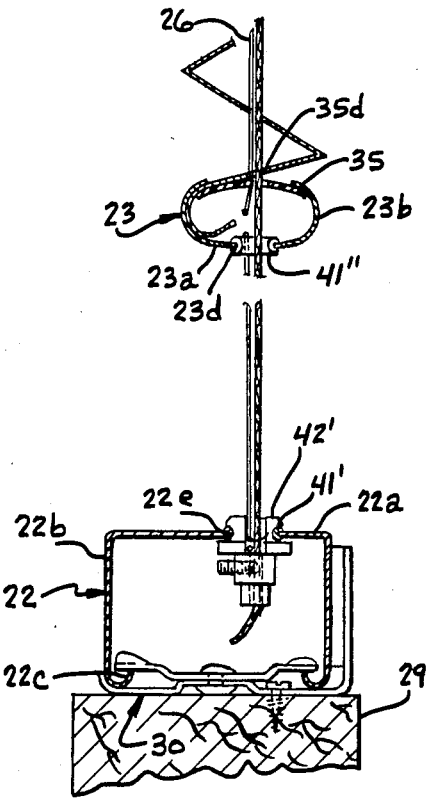
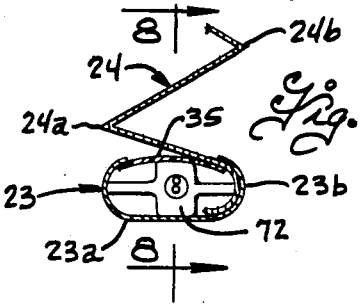
Fig. 7.
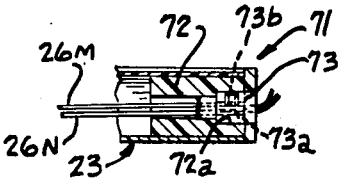
Fig. 8.

ADJUSTABLE SHADE

BACKGROUND OF THE INVENTION

In some adjustable shade installations, including some installations in conventional vertically disposed window openings as well as installations in skylights and sun roofs where the opening is inclined to the vertical or even horizontal, it is desirable to guidably support the shade and the movable intermediate rail during movement of the shade between an open and closed position. It has been proposed, for example as disclosed in U.S. Pat. Nos. 1,289,281 and 1,663,819, to provide adjustable shades in which guide cords are tensioned between two fixed headrails at opposite sides of the window opening and extend through a set of tension cord openings to guide the shade and rail during movement between open and closed positions, and in which draw cords are attached to the movable rail and extend through draw cords are attached to the movable rail and extend through draw cord openings that are separate from the tension cord opening to effect movement of the intermediate rail and shade between open and closed positions. It has also been proposed, for example as disclosed in U.S. Pat. Nos. 3,721,285 and 4,557,309 to arrange the draw cords and tension cords so that both extend through the same openings in the shade and headrails and intermediate rail. However, when the tension cords and draw cords extend through the same openings, problems are sometimes encountered with interference between the draw and tension cords which not only obstructs movement of the shade but also increase wear on one or the other of the cords.

In the draw cord arrangement disclosed in the abovementioned patents, the draw cords are adapted to pull the intermediate or movable rail toward a raised position, and a cord lock or cord tie is provided for holding the intermediate rail in an adjusted position. However, such draw cord arrangements are not suitable for use in applications where the window opening is horizontal or so close to horizontal that the intermediate rail cannot be gravity actuated to its lower position.

SUMMARY OF THE INVENTION

It is an object of the present invention to provide an adjustable shade having tension cords extending between fixedly spaced headrails for guiding the movable intermediate rail and shade member for movement between open and closed positions, and a draw cord system for moving the movable rail and shade member relative to the fixed headrails, and which has an improved arrangement for guiding the tension cords and draw cords through the same openings in at least one of the headrails, to prevent interference between the draw and tension cords.

Another object of this invention is to provide an adjustable shade having tension cord means extending between fixedly spaced headrails and through the shade member and a movable intermediate rail to guide the shade member and movable rail during movement between open and closed positions, and which has an improved draw cord system for positively moving the movable intermediate rail in both directions relative to the headrails and for maintaining the intermediate rail and shade member in adjusted position relative to the fixed headrails.

According to one aspect of the present invention, the adjustable shade comprises first and second parallel headrails and an intermediate rail and a foldable shade member attached to one of the headrails and the intermediate rail. The shade member has at least first and second rows of aligned openings therein and the headrails and intermediate rail each have first and second openings respectively aligned with the first and second rows of openings in the shade member. First and second guide bushings are provided in the first and second openings in the first headrail and each guide bushing defines a central guide opening. First and second guide buttons are mounted in the first and second guide bushings and the guide buttons each have a cord notch extending inwardly of the periphery with the inner end of the notch spaced radially inwardly of the guide opening in the respective guide bushing, and a tension cord passage that extends through each guide bushing at a location spaced from the cord notch. Tension cord means are provided for guiding the intermediate rail and shade member, and the tension cord means includes first and second tension cords extending through the cord passage in the respective first and second cord guide buttons and through the respective first and second rows of aligned openings in the shade member and through the respective first and second openings in the intermediate rail and the second headrail, and means are provided for anchoring the first and second tension cords to the headrails. The first headrail has draw cord exit means spaced from the first and second openings and draw cord means are provided for moving the intermediate rail relative to the headrails. The draw cord means includes first and second draw cords each connected to the intermediate rail and extending through the first and second rows of openings in the shade member and through the notches on the respective first and second cord guide buttons, with the first and second draw cord means having portions extending from the respective first and second cord guide buttons lengthwise of the first headrail and through the draw cord exit means.

According to another aspect of the present inventions, the adjustable shade comprises first and second parallel headrails and an intermediate rail and a foldable shade member attached to one of the headrails and to the intermediate rail, the shade member having at least first and second rows of aligned openings therein. The headrails each have first and second openings therein respectively aligned with the first and second rows of openings in the shade member and a cord exit means adjacent one end. The intermediate rail includes a pair of spaced lengthwise extending walls each having first and second openings respectively aligned with the first and second rows of openings in the shade member. Tension cord means are provided for guiding the intermediate rail and shade member and the tension cord means includes first and second tension cords respectively extending through the first and second rows of openings in the shade member and through the first and second openings in the pair of lengthwise extending walls of the intermediate rail and through the first and second openings in each of the first and second headrails, with means for anchoring the first and second tension cords to the first and second headrails. A draw cord means is provided for moving the intermediate rail relative to the headrails, and the draw cord means includes first and second draw cords extending through respective first and second openings in one wall of the intermediate rail to and through first and second rows of openings in the shade member and through the first and second openings in one headrail and then lengthwise of said one headrail to a draw cord exit means in that headrail and then from the draw cord exit means in said one headrail to and through the draw cord exit means in the other headrail and from the draw cord exit means in the other headrail lengthwise of said other headrail and through the respective first and second openings in said other headrail to and through the respective first and second openings in the other wall of the intermediate rail, and means for adjustably anchoring the first and second draw cord means to the intermediate rail.

BRIEF DESCRIPTION OF THE DRAWINGS

FIG. 1 is a perspective view of an adjustable shade embodying the present invention;

FIG. 2 is a fragmentary horizontal sectional view taken on the plane 2—2 of FIG. 1 and illustrating parts on a larger scale than FIG. 1;

FIG. 3 is a fragmentary transverse sectional view taken on the plane 3—3 of FIG. 2;

FIG. 4 is a vertical sectional view taken on a plane 4—4 of FIG. 1 and illustrating parts on a larger scale than FIG. 1;

FIG. 5 is a fragmentary sectional view taken on the plane 5—5 of FIG. 1;

FIG. 6 is a fragmentary sectional view taken on the plane 6—6 of FIG. 1;

FIG. 7 is a fragmentary sectional view taken on the plane 7—7 of FIG. 1;

FIG. 8 is a fragmentary sectional view taken on the plane 8—8 of FIG. 7;

DETAILED DESCRIPTION

Figure 9:
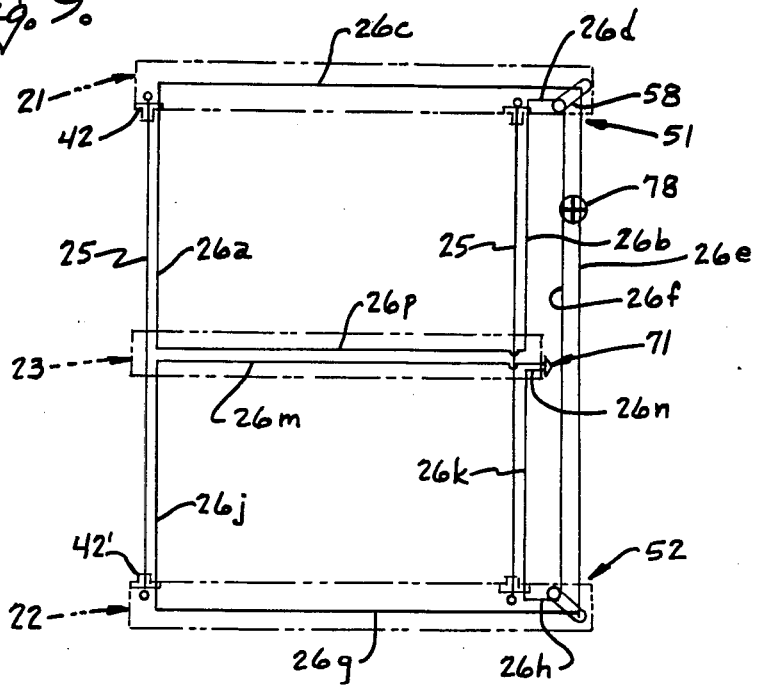
FIG. 9 is a diagrammatic view illustrating the tension cord and draw cord system for normal size shades.

The adjustable shade in general includes first and second headrails 21 and 22 adapted to be fixedly attached in parallel relation in a window opening, skylight opening, sun roof or the like, and a movable intermediate rail 23 that is disposed between and parallel to the headrails 21 and 22. A shade member 24 is attached to one of the headrails such as the headrail 21 and to the intermediate rail 23. The shade member is formed of a web of material which retains its folds, for example impregnated textile fabric, metalized textile material, paper, plastic or the like, and the shade member is reversely folded upon itself along parallel fold lines 24*a*, 24*b* to provide a corrugated or zigzag folded panel. Tension cord means 25 are attached to the headrails and arranged to guidably support the intermediate rail and shade member during movement between open and closed positions, and draw cord means 26 are provided for moving the movable rail 23 and shade member relative to the stationary head rails between open and closed positions.

The headrails 21 and 22 are adapted to be attached to support structures such as frame members 28 and 29 of a window or skylight opening, in fixed parallel spaced relation to each other. In the embodiment shown, headrail 21 is in the form of a channel-shaped housing having a base wall 21*a*, spaced sidewalls 21*b* with inwardly rolled edges 21*c*, and end caps 21*d* (FIG. 1) at opposite ends of the housing. Headrail 22 is conveniently the same as headrail 21 and includes a base wall 22*a*, side walls 22*b* having inwardly rolled edges 22*c* and end caps 22*d*. The headrails 21 and 22 are mounted in fixed spaced parallel relation to the frame members 28 and 29, as by brackets 30. The brackets are of conventional construction and, as best shown in FIG. 4, include a base 31 attached as by fasteners 31*a* to the respective frame members, and a latch 32 that is pivotally mounted as by a rivet 33 on the base member for movement into and out of position overlying inwardly rolled edges 21*c* on the headrails 21 and 22. The mounting brackets 30 are of conventional construction and further detailed description is deemed unnecessary.

The movable intermediate rail 23 is preferably arranged to form a lengthwise extending enclosure and, in the embodiment shown, includes a housing of generally C-shaped cross-section having a lengthwise extending base wall 23*a* and lengthwise extending side walls 23*b*, and a lengthwise extending insert wall 35 that extends between the open sides of the C-shaped housing and defines a wall spaced from the base wall 23*a*. The shade member 24 is attached to the base wall 21*a* of one of the headrails 21 in any suitable manner, for example by adhesive, fasteners or the like, and is attached to the intermediate rail 23, as by having an end portion disposed between the insert wall 35 and one of the side walls 23*b* of the intermediate rail. It is deemed apparent that other means such as adhesive could be used to attach the shade to the intermediate rail.

At least two rows of aligned openings 38*a* and 38*b* are formed in the shade member 24 with the openings preferably arranged approximately medially between the fold lines 24*a* and 24*b* of the shade material. As pointed out more fully hereinafter, wider shades can be provided with additional rows of openings at spaced locations along the shade member. The headrails 21 and 22 have openings 21*e*, 22*e* respectively in the base wall thereof aligned with respective ones of the rows of openings 38*a*, 38*b* in the shade member, and the base wall 23*a* and insert 35 of the intermediate rail 23 have openings 23*d* and 35*d* respectively aligned with respective ones of the rows of openings 38*a* and 38*b* in the shade. A guide bushing 41 is provided in each of the openings 21*d* in the headrail 21, which guide bushings are preferably in the form of an annular grommet or eyelet that define a central guide opening and outwardly extending flange portions that overlie the opposite sides of the base wall 21*a*. A guide button 42 is mounted in each of the guide bushings 41. As best shown in FIGS. 2–4, the guide buttons each include a head portion 42*a* that is larger than the guide opening in the bushing 41 and which is adapted to overlie one side of the guide bushing, and a stem portion 42*b* that extends through the opening in the guide bushing 41. The guide button 42 is preferably formed of a resilient plastic material and the stem portion 42*b* is advantageously in the form of a pair of laterally spaced resilient legs that extend through the central guide opening in the bushing and which have protrusions 42*c* extending laterally outwardly to engage the side of the bushing 41 opposite the head 42*a* for retaining the guide button on the bushing. As best shown in FIG. 3, the protrusions 42*c* have a rounded end which is adapted to cam the legs inwardly when the button is pressed into the guide bushing and the legs thereafter move outwardly so that the protrusions underlie the guide bushing.

Each guide button has a notch 42*d* that extends inwardly of the periphery of the head 42*a* and with the apex of the notch spaced radially inwardly of the opening in the guide bushing 41, to provide a draw cord passage. As best shown in FIGS. 2 and 3, the notch 42*d* is located so as to register with the opening between the leg portions 42*b* of the button. Each guide button also has a tension cord passage 42*e* extending therethrough and spaced from the notch 42*d*. The tension cord passage is preferably axially aligned with the central opening in the guide bushing 41. The guide bushing is shaped to form a circular central opening and the guide button 42 can turn in the opening in the guide bushing so that the notch 42*d* in the guide button can be oriented in any desired angular position.

In the preferred embodiments illustrated, the draw cord means extends through both of the headrails 21 and 22. Accordingly, headrail 22 is also provided with a guide bushing 41' in each of the openings 22*e* and a guide button 42' is mounted in each of the guide bushings 41'. Guide bushings 41' are conveniently of the same configuration as the guide buttons 42 and like numerals are used to designate corresponding parts. As best shown in FIGS. 1 and 4, the guide buttons 42 and 42' are arranged so that the head portions 42*a* are disposed inside the respective headrail and overlie the inner side of the respective guide bushing.

The tension cord means 25 includes a tension cord individual to each of the rows of openings in the shade member 24. A tension cord extends through the central opening 42*e* in each of the guide buttons 42 and through a respective one of the rows of openings 38*a*, 38*b* in the shade member, and through the openings 35*d* and 23*d* in the intermediate rail, and through the central opening 42*e* in a respective one of the other of the guide buttons 42'. Tension cord anchors are provided for anchoring the ends of the tension cords to the headrails 21 and 22. The tension cord anchors can conveniently be in the form of a sleeve 48 having a passage 48*a* therethrough and a means such as a set screw 48*b* that is threaded in the sleeve 48 and intersects the passage 48*a* and which is threadedly adjustable to clamp the tension cord 25 to the sleeve. The anchors 48 are adjusted on the tension cords 25 so that the tension cords extend between the headrails and the shade member 24 under sufficient tension to support and guide the intermediate rail 23 and shade member 24 during movement between an open and closed position. The C-shaped housing of the intermediate rail 23 is conveniently formed of metal and the insert 35 formed of a strip of relatively stiff plastic. In order to minimize wear on the tension and draw cords during movement of the intermediate rail, a guide bushing 41', conveniently similar to the guide bushings 41, is provided at least in the openings 23*d* in the metal portion of the housing 23. A similar guide bushing can be provided in the opening 35*d* in the insert wall, if desired.

The headrails 21 and 22 have cord exit means 51, 52 adjacent one end and spaced from the openings 21*e*, 22*e* respectively. The cord exit means 51 and 52 are conveniently of like construction and the same numerals are used to designate the corresponding parts. The cord exit means each include an opening 53 in the respective headrail and a cord guide 54 that is mounted in the opening in the respective headrail and which defines a cord guide opening 54*a*. Cord guide means are provided for guiding the draw cords from the respective head rail through the opening 53. The cord guide means includes a generally U-shaped bracket 57 that is mounted in each of the headrails and which has a cord guide pulley 58 rotatably supported on a pin 59 for guiding the draw cords from the respective headrail through the exit opening 54*a*. A cord centering guide 61 is provided for guiding the draw cords in a respective headrail onto the pulleys 58. The guide 61 is conveniently in the form of a unitary member of plastic or the like having spaced U-shaped portions that are suspended on a pin 62 between the sides of the bracket 57 and which U-shaped portions are interconnected by connecting portions at their lower ends. The spaced U-shaped portions straddle the draw cords at a location in advance of the respective guide pulley 58, to maintain the draw cords intermediate the ends of the guide pulley.

The draw cord means 26 is attached to the intermediate rail 23 and extends through one and preferably both of the headrails in a manner described more fully hereinafter. As best shown in FIG. 9, draw cord means includes portions 26*a*, 26*b*, that extend upwardly through openings 35*d* in the intermediate rail 23 and through respective ones of the rows of aligned openings 38*a*, 38*b* in the shade member and to and through the notch in a respective one of the guide buttons 42 in the headrail 21. The draw cords are guided laterally over the guide bushing 41 associated with each guide button and have portions 26*c* and 26*d* that extend lengthwise of the headrail 21 over the guide pulley 58 and out through the draw cord exit means 51. The draw cord means also includes portions 26*e* and 26*f* that extend from the draw cord exit means 51 in one headrail to and through the draw cord exit means 52 in the other headrail and over the guide pulley 58 in that headrail. The draw cord means also includes portions 26*g* and 26*h* that extend lengthwise of the headrail 22 and through the notches in respective ones of the guide buttons 42' in the headrail 22 and portions 26*j* and 26*k* that extend upwardly to and through the guide openings 23*d* in the intermediate rail 23. Portions 26*m* and 26*n* of the draw cord means extend lengthwise of the intermediate rail to a draw cord anchor means 71 at one end of the intermediate rail 23. As best shown in FIGS. 7 and 8, the draw cord anchor means includes end cap 72 inserted into an end of the intermediate rail 23 and which has a flange overlying one end of the intermediate rail. The end cap 72 has a stepped passage 72*a* therein and a sleeve 73, conveniently the same as anchor 48, is formed with a draw cord passage 73*a* therethrough and a laterally extending locking means such as a set screw 73*b* which can be tightened to clamp the end of the draw cords in the passage 73*a*. In the preferred embodiment shown, the draw cord portions 26*a* and 26*b* are interconnected to each other by a portion 26*p* that extends lengthwise of the intermediate rail, so that the draw cord means comprises a single continuous loop. Alternatively, draw cord portions 26*a* and 26*b* could be individually anchored to the intermediate rail.

The portions 26*e* and 26*f* of the draw cords that extend between the cord exit means and the rails 21 and 22 form a shade operating portion which can be grasped to move the intermediate rail relative to the headrails. The draw cord portions 26*e* and 26*f* are advantageously interconnected to each other as by a device 78 to effect operation of the draw cords simultaneously. As is apparent, movement of the device 78 in one direction will move the headrail in the opposite direction and vice versa. Thus, the intermediate rail and shade member can be positively moved in both directions by operation of the draw cord portions 26*e* and 26*f*. Since the adjustable shade does not rely on gravity to move the intermediate rail in one direction, it can be used not only in installations where the shade is upright, but also in installations where the shade is inclined or even horizontal. It is contemplated that the draw cords be anchored to the intermediate rail under tension such that the friction of the draw cords against the various guide bushings 41 will hold the intermediate rail in any preselected adjustable position, without requiring a draw cord lock or draw cord tie to hold the intermediate rail in its adjusted position. Tension on the draw cords can be easily adjusted by loosening the set screw *73b* and pulling the ends *26m* and *26n* of the draw cords through the passage *73a* until the desired tension is achieved. The set screw *73b* is then tightened and pushed back into the stepped passage in the end cap 72. The tension cord anchor 71 is preferably located at the end of the intermediate rail 23 that is adjacent to the operating portions *26e* and *26f*.

Figure 10:
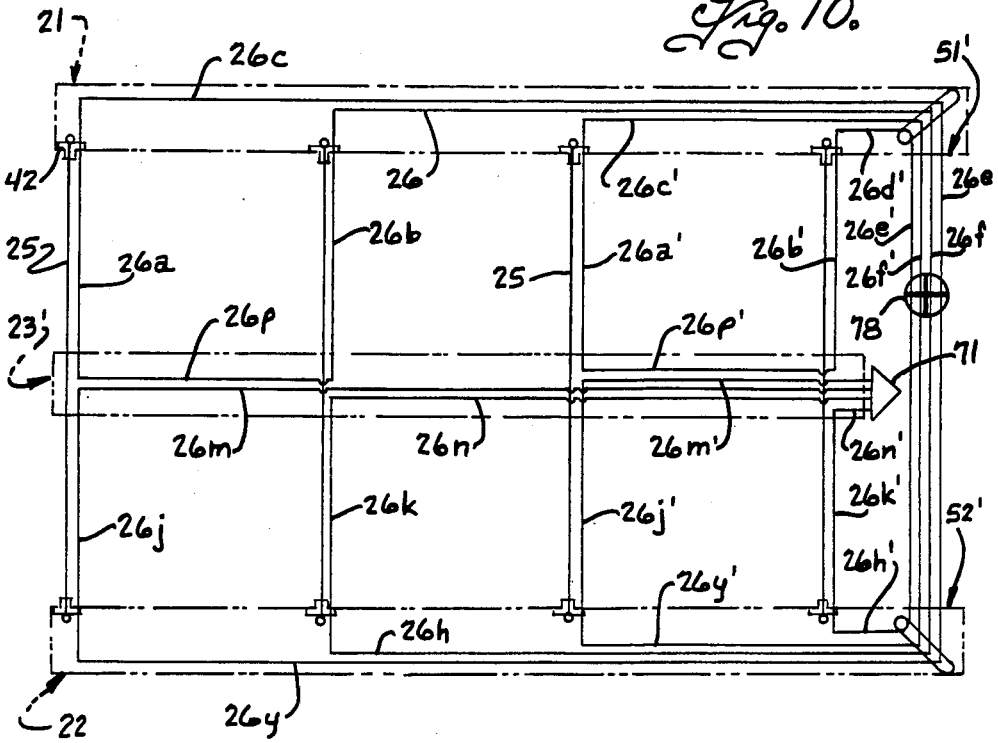
FIG. 10 is a diagrammatic view illustrating the tension and draw cord system for wide shades.

FIG. 10 diagrammatically illustrates the invention adapted to a wider adjustable shade having four rows of openings in the shade member and four tension cords 25. In this embodiment, two draw cord systems are provided. One draw cord system is the same as that described in connection with FIG. 9 and like numerals are used to designate corresponding parts of the draw cords. The other draw cord system is similar to that previously described and like numerals followed by the postscript' are used to designate corresponding portions of the draw cords. As will be seen, the operating portions *26e, 26f,* and *26e', 26f'* of both draw cord systems are interconnected by the device 78, and the ends of both draw cords are similarly anchored by the same anchor device 71 at one end of the intermediate rail. Thus, both draw cord systems are operated simultaneously in unison.

In the embodiment illustrated in FIG. 10, one of the draw cord systems is arranged with its cord portions *26a* and *26j* and *26b, 26k* adjacent the left side of the shade as viewed in FIG. 10, and the other of the draw cord system is arranged with the cord portions *26a', 26j'* and *26b'* and *26k'* adjacent the right side of the shade. It is deemed apparent that one of the draw cord systems could be arranged with the cord portions *26a, 26j* adjacent the left end of the shade and cord portions *26b, 26k* adjacent the right end of the shade, and that the other draw cord system arranged with its cord portions *26a', 26j'* and *26b', 26k'* intermediate the ends of the shade.

The tension cords can be formed of metal or natural or synthetic fiber and can be of monofilament or of twisted or braided construction as desired. The guide bushings 41, 41' and 41" are preferably formed of metal or wear resistant plastic to minimize wear and scoring when the draw cord passes thereover.

From the foregoing it is felt that the construction and operation of the adjustable shade will be readily understood. The guide bushings 41 and guide buttons 42 maintain the tension cords and draw cords separated as they pass therethrough so as to minimize interference and wear between the draw and tension cords. The guide buttons can turn in the guide portions so that the notches can be aligned with the portions of the draw cords that extend lengthwise of the respective headrail.

The draw cord system is arranged so that the draw cords are anchored to the intermediate rail and have an operating portion that extends between the spaced headrails and which is operable to move the intermediate rail and shade member in both directions. Further, the tension of the draw cord system can be adjusted so that the friction of the draw cord as it passes over the several guide bushings holds the intermediate rail in an adjusted position without requiring the use of draw cord locks or draw cord ties.

The embodiments of the invention in which an exclusive property or privilege is claimed are defined as follows:

1. An adjustable shade comprising, first and second parallel headrails and an intermediate rail between and parallel to the headrails, a foldable shade member attached to one of the headrails and to said intermediate rail, said shade member having at least first and second rows of aligned openings therein, the headrails and the intermediate rail each having first and second openings therein respectively aligned with said first and second rows of openings in the shade member, first and second annular guide bushing means in the first and second openings in said first headrail each defining a central guide opening, first and second guide buttons respectively mounted in said first and second guide bushing means, said guide buttons each having a cord notch extending inwardly of the periphery thereof with the radially inner end of the notch spaced radially inwardly of the guide opening in the respective guide bushing means and a tension cord passage therethrough spaced from the cord notch, tension cord means for guiding the intermediate rail and the shade member, the tension cord means including first and second tension cords extending through the tension cord passage in the respective first and second cord guide buttons and through the respective first and second rows of aligned openings in the shade member and through the respective first and second openings in the intermediate rail and the second headrail, means for anchoring said first and second tension cords to each of said headrails, the first headrail having draw cord exit means spaced from said first and second openings therein, draw cord means for moving the intermediate rail relative to said headrails, said draw cord means including first and second draw cord portions each connected to the intermediate rail and extending through the respective first and second rows of openings in the shade member and through the notches in the respective first and second cord guide buttons, the first and second draw cord means having portions extending from the respective first and second cord guide buttons lengthwise of the first headrail and through the draw cord exit means.

2. An adjustable shade according to claim 1 wherein said guide buttons are mounted for turning in the guide openings of the respective guide bushing means to allow the notches in the buttons to align with the portions of the respective first and second draw cords that extend lengthwise of the first headrail.

3. An adjustable shade according to claim 1 wherein said tension cord opening in each guide button is generally coaxial with the associated annular guide bushing means.

4. An adjustable shade according to claim 1 wherein said means for anchoring the first and second tension cords on the first headrail includes first and second cord anchors each overlying a respective one of the guide buttons and each having a passage therethrough, and means on each cord anchor in engagement with a tension cord in the passage in the cord anchor for locking the tension cord against movement.

5. An adjustable shade according to claim 1 wherein said guide buttons each include a head portion at one end larger than the guide opening in the respective annular guide bushing means and a shank portion extending from the head portion through the guide opening in the respective guide bushing means, said shank portion of each guide button being adapted to turn in the guide opening in the respective guide bushing means to allow the notches in the buttons to align with the portions of the respective first and second draw cord means that extend lengthwise of the first headrail.

6. An adjustable shade according to claim 5 including means on the shank portion spaced from the head portion for engaging the respective guide bushing means to releasably retain the guide button on the guide bushing means.

7. An adjustable shade according to claim 1 wherein said cord guide buttons each include a head portion at one end larger than the guide opening in the respective annular guide bushing means and a pair of leg portions extending from the head portion through the guide opening in the respective cord guide bushing means, said notch extending inwardly of the periphery of the head portion at a location intermediate said leg portions.

8. An adjustable shade according to claim 7 including lateral protrusions on said leg portions and spaced from said head portion for engaging the respective guide bushing means to releasably retain the guide button on the guide bushing means.

9. An adjustable shade according to claim 1 wherein the second headrail has cord exit means spaced from the first and second openings therein, third and fourth annular guide bushing means in the respective first and second openings in said second headrail, and third and fourth guide buttons mounted in said third and fourth guide bushing means, the third and fourth guide buttons each having a cord notch extending inwardly of the periphery thereof and a cord passage therethrough spaced from the cord notch, the first and second tension cords extending through the cord openings in the third and fourth guide buttons, the draw cord means having third and fourth draw cord portions connected to said intermediate rail and extending through the notches in said third and fourth guide buttons and having portions extending lengthwise of the second headrail from the third and fourth guide buttons to said cord exit means in the second headrail.

10. An adjustable shade according to claim 9 wherein the draw cord means includes means interconnecting the first and second draw cords and the third and fourth draw cords intermediate the first and second headrails to operate the first and second draw cords and the third and fourth draw cords simultaneously in relatively opposite directions.

11. An adjustable shade according to claim 10 wherein said intermediate rail has a pair of spaced walls extending lengthwise thereof, said first and second openings in the intermediate rail extending through said pair of spaced walls, said first and second draw cord portions extending through the respective first and second openings in one of said walls of the intermediate rail, said third and fourth draw cord portions extending through the respective first and second openings in the other wall of the intermediate rail.

12. An adjustable shade comprising first and second parallel headrails and an intermediate rail between and parallel to the headrails, a foldable shade member attached to one of the headrails and to the intermediate rail, said shade member having at least first and second rows of aligned openings therein, the headrails each having first and second openings therein respectively aligned with the first and second openings in the first and second rows of openings in the shade member and cord exit means adjacent one end thereof, the lengthwise extending walls of the intermediate rail each having first and second openings therein respectively aligned with the first and second rows of openings in the shade member, tension cord means for guiding the intermediate rail and the shade member, the tension cord means including first and second tension cord portions respectively extending through the first and second rows of openings in the shade member and through the first and second openings in the pair of the lengthwise extending walls of the intermediate rail and through the first and second openings in each of the first and second headrails, means for anchoring the first and second tension cords to the first and second headrails, draw cord means for moving the intermediate rail relative to the headrails, said draw cord means including first and second draw cords extending respectively through the first and second openings in one wall of the intermediate rail sequentially to and through the respective first and second rows of openings in the shade member and the first and second openings in one headrail and then lengthwise of said one headrail to the draw cord exit means in that headrail and then from the draw cord exit means in said one headrail to and through the draw cord exit means in the other headrail and from the draw cord exit means in said other headrail lengthwise of said other headrail to and through the respective first and second openings in said other headrail and then to and through the respective first and second openings in the other wall of the intermediate rail, and means for adjustably anchoring the first and second draw cords to the intermediate rail, an annular guide grommet in each of the first and second openings in the first and second headrails each defining a central guide opening, a guide button in each of said grommets, said guide buttons each having a draw cord notch extending inwardly of the periphery thereof with the radially inner end of the notch spaced radially inwardly of the guide opening in the respective guide grommet and a tension cord passage therethrough spaced from the draw cord notch.

13. An adjustable shade comprising, first and second parallel headrails and an intermediate rail between and parallel to the headrails, a foldable shade member attached to one of the headrails and to the intermediate rail, said shade member having at least first and second rows of aligned openings therein, the headrails each having first and second openings therein respectively aligned with the first and second openings in the shade member, the intermediate rail including a pair of spaced extending lengthwise walls each having first and second openings therein respectively aligned with the first and second rows of openings in the shade member, tension cord means for guiding the intermediate rail and the shade member, the tension cord means including first and second tension cords respectively extending through the first and second rows of openings in the shade member and through the first and second openings in the intermediate rail and through the first and second openings in the first and second headrails, means for anchoring the first and second tension cords on the first and second headrails, the first and second headrails respectively having first and second cord exit means adjacent one end, draw cord means for moving the intermediate rail relative to the headrails, said draw cord means comprising a single draw cord loop including an intermediate portion extending lengthwise of the intermediate rail between the first and second walls thereof and first and second draw cord portions extending respectively through the first and second openings in one wall of the intermediate rail sequentially to and through the first and second rows of openings in the shade member and the first and second openings in one headrail and then lengthwise of said one headrail to and through the draw cord exit means in said one headrail to and through the draw cord exit means in the other headrail and from the draw cord exit means in said other headrail lengthwise of said other headrail to and through the respective first and second openings in said other headrail and then to and through the respective first and second openings in the other wall of the intermediate rail and then lengthwise of the intermediate rail between the walls thereof to one end of the intermediate rail, the draw cord loop terminating in first and second draw cord end portions adjacent said one end of the intermediate rail, and means for adjustably anchoring the first and second draw cord end portions to said intermediate rail at said one end thereof, an annular guide grommet in each of the first and second openings in the first and second headrails each defining a central guide opening, a guide button in each of said guide grommets, said guide buttons each having a draw cord notch extending inwardly of the periphery thereof with the radially inner end of the notch spaced radially inwardly of the guide opening in the respective guide grommet and a tension cord passage therethrough spaced from the draw cord notch.

14. A foldable shade according to claim 13 wherein said guide buttons are mounted for turning in said guide grommets.

* * * * *